US010493779B2

(12) United States Patent
Vestjens et al.

(10) Patent No.: US 10,493,779 B2
(45) Date of Patent: Dec. 3, 2019

(54) PRINTING SYSTEM

(71) Applicant: OCÉ-TECHNOLOGIES B.V., Venlo (NL)

(72) Inventors: Patrick G. H. Vestjens, Venlo (NL); Jacobus J. Kandelaars, Venlo (NL); Antonius H. L. Boots, Venlo (NL)

(73) Assignee: OCÉ-TECHNOLOGIES B.V., Venlo (NL)

( * ) Notice: Subject to any disclaimer, the term of this patent is extended or adjusted under 35 U.S.C. 154(b) by 0 days.

(21) Appl. No.: 15/797,682

(22) Filed: Oct. 30, 2017

(65) Prior Publication Data

US 2018/0056679 A1 Mar. 1, 2018

Related U.S. Application Data

(63) Continuation of application No. PCT/EP2016/059775, filed on May 2, 2016.

(30) Foreign Application Priority Data

May 7, 2015 (EP) ..... 15166678

(51) Int. Cl.
*B41J 13/00* (2006.01)
*B41J 11/00* (2006.01)
(Continued)

(52) U.S. Cl.
CPC ..... *B41J 13/0027* (2013.01); *B41J 2/01* (2013.01); *B41J 11/009* (2013.01);
(Continued)

(58) Field of Classification Search
CPC ... B41J 13/0027; B41J 2/01; B41J 3/60; B41J 11/0095; B41J 13/0018; B41J 11/009;
(Continued)

(56) References Cited

U.S. PATENT DOCUMENTS 5,917,727 A 6/1999 Richardson et al.
2016/0016744 A1* 1/2016 Turke ..... B41F 33/009 270/52.02

FOREIGN PATENT DOCUMENTS

JP 62-32066 A 2/1987
JP 2009-190877 A 8/2009

OTHER PUBLICATIONS

International Search Report, issued in PCT/EP2016/059775 (PCT/ISA/210), dated Jun. 2, 2016.
(Continued)

*Primary Examiner* — Justin Seo
(74) *Attorney, Agent, or Firm* — Birch, Stewart, Kolasch & Birch, LLP

(57) ABSTRACT

A printing system includes a print station disposed at a sheet transport path, a feed section arranged to feed media sheets of different media types into the transport path so as to be fed sequentially to the print station, and a controller arranged to receive print instructions concerning images to be printed, to schedule a sequence of the media sheets, and to control the feed section and the print station such that each image is printed on a sheet of a media type that has been specified for that image in the print instructions. A sensor is arranged at the transport path for detecting a quality condition of the sheets being fed to the print station, and the controller is adapted to receive a quality signal from the sensor and, when the quality of a sheet is found to be insufficient, to skip that sheet and to reroute the corresponding image to another scheduled sheet that is compatible with the print instructions.

19 Claims, 6 Drawing Sheets

(51) Int. Cl.

| | |
|---|---|
| ***B65H 7/06*** | (2006.01) |
| ***B65H 7/20*** | (2006.01) |
| ***G03G 15/00*** | (2006.01) |
| ***B65H 85/00*** | (2006.01) |
| ***B41J 2/01*** | (2006.01) |
| ***B65H 5/26*** | (2006.01) |
| ***B65H 29/60*** | (2006.01) |
| ***B65H 29/62*** | (2006.01) |
| *B41J 3/60* | (2006.01) |

(52) U.S. Cl.
CPC ..... *B41J 11/0095* (2013.01); *B41J 13/0018* (2013.01); *B65H 5/26* (2013.01); *B65H 7/06* (2013.01); *B65H 7/20* (2013.01); *B65H 29/60* (2013.01); *B65H 29/62* (2013.01); *B65H 85/00* (2013.01); *G03G 15/5029* (2013.01); *G03G 15/55* (2013.01); *G03G 15/6508* (2013.01); *B41J 3/60* (2013.01); *B65H 2511/413* (2013.01); *B65H 2511/512* (2013.01); *B65H 2513/42* (2013.01); *B65H 2515/84* (2013.01)

(58) Field of Classification Search
CPC ..... G03G 15/5029; G03G 15/55; G03G 15/6508; B65H 7/06; B65H 2511/413; B65H 2511/512; B65H 2515/84; B65H 2513/42; B65H 29/62; B65H 29/60; B65H 5/26; B65H 7/20; B65H 85/00
See application file for complete search history.

(56) References Cited

OTHER PUBLICATIONS

Written Opinion of the International Searching Authority, issued in PCT/EP2016/059775 (PCT/ISA/237), dated Jun. 2, 2016.

* cited by examiner

PRINTING SYSTEM

CROSS REFERENCE TO RELATED APPLICATIONS

This application is a Continuation of International Application No. PCT/EP2016/059775, filed on May 2, 2016, and for which priority is claimed under 35 U.S.C. § 120. PCT/EP2016/059775 claims priority under 35 U.S.C. § 119 to Application No. 15166678.1, filed in Europe on May 7, 2015. The entirety of each of the above-identified applications is expressly incorporated herein by reference.

BACKGROUND OF THE INVENTION

1. Field of the Invention

The invention relates to a printing system comprising a print station disposed at a sheet transport path, a feed section arranged to feed media sheets of different media types into the transport path so as to be fed sequentially to the print station, and a controller arranged to receive print instructions concerning images to be printed, to schedule a sequence of the media sheets, and to control the feed section and the print station such that each image is printed on a sheet of a media type that has been specified for that image in the print instructions.

2. Background of the Invention

In such a printing system, depending upon the type of print engine installed in the print station, it may be desirable or even necessary to monitor the quality of the sheets that are fed to the print station. For example, when the print engine is an ink jet printer for printing high quality images, the nozzles of the print head will be arranged at a very small spacing above the top surface of the sheets that are conveyed on the transport path. Consequently, the top surfaces of the sheets must be perfectly flat in order to prevent the sheets from colliding with the print head.

It may therefore be considered to scan the surfaces of the sheets in the transport path upstream of the print station with a sensor, e.g., a 3D laser scanner, and when the sensor detects any wrinkles or other surface irregulaties of a sheet, this sheet will be skipped in the print sequence, e.g. by removing the sheet from the transport path before it reaches the print station.

However, when the sequence of sheets is a mixed sequence of sheets of different media types, e.g. sheets with different thickness, material or surface properties, skipping a defective sheet will result in a mismatch between the sequence of sheets and the sequence of images to be printed thereon, so that the media type specifications in the print instructions would not be complied with. It would therefore be necessary to discard the entire sequence of sheets that have been fed into the transport path already, with the result that the productivity of the printing system is compromised and the waste of material (media sheets and ink) is increased.

SUMMARY OF THE INVENTION

It is an object of the invention to provide a printing system that can assure high quality of the printed images and nevertheless permits a high productivity and a reduction of waste.

In order to achieve that object, according to the invention, a sensor is arranged at the transport path for detecting a quality condition of the sheets being fed to the print station, and the controller is adapted to receive a quality signal from the sensor and, when the quality of a sheet is found to be insufficient, to skip that sheet and to reroute the corresponding image to another scheduled sheet that is compatible with the print instructions.

When a defective sheet is detected in the printing system according to the invention, it is not necessary to discard the entire batch of sheets that are present in the transport path (and possibly a duplex loop) at that instant. Instead, only the defective sheet will be discarded, and the image that should have been printed onto that sheet will be printed later onto another sheet that is selected from the sequence in accordance with the selection criterion that the media type of the selected sheet must fit with the print instructions for the pertinent image. In this way, the schedule is automatically re-arranged such that the print process needs not be interrupted and at least some of the sheets that are present in the transport path already can still be used for printing, so that the objectives of high productivity and low waste can be achieved.

More specific optional features of the invention are indicated in the dependent claims.

In a preferred embodiment, when a print job comprises a plurality of successive pages, the controller is arranged to reroute the images with the constraint that the rerouting does not change the order in which the pages of the job are printed. This assures that the printed sheets will leave the print station in the correct order and, in case of duplex printing, with the correct orientation, so that, in order to obtain collated copies, it is not necessary to re-collate the sheets when they leave the print station.

In this case, it may be necessary to skip further sheets, even if they are not defective, in order to re-synchronize the sequence of sheets with the sequence of images. As a typical print job consists of printing multiple copies of a multi-page document, the media types of the sheets in the sequence will fulfil a repetitive pattern. In that case, it will generally be sufficient to skip only a few sheets until the sequences of sheets and images are synchronized again. It may however not always be the best strategy to reroute an image to the very first one of the following sheets that fulfils the selection criteria. In some cases it may be better to skip some extra sheets in the first place, because this may provide a possibility to re-synchronize the sequence of sheets with the repetitive pattern more quickly, so that the total number of discarded sheets will eventually become smaller. A repetitive pattern in the sequence of the media types may also occur within a single copy of the document. It may therefore be attractive to employ a known pattern recognition algorithm for recognizing such repetitive patterns and to adapt the rerouting scheme to the recognized pattern.

Further, if there are sheets that have been scheduled for printing already but have not yet been fed into the transport path, the controller may re-schedule these sheets in order to enforce synchronism between sheets and images. Of course, when new sheets are scheduled for the first time, the controller may take into account the fact that the sequence of images has been shifted due to defective sheets, so that the new sheets will be scheduled correctly from the outset.

Another criterion that may have to be observed when images are rerouted may be that the sheet to which the image is rerouted must comply with certain constraints that are imposed by a finishing process to which the printed sheets are subjected after they have left the print station.

The invention is applicable to both simplex printing and duplex printing and is particularly useful for duplex printing wherein a batch of sheets on which an image has been formed on a first side is looped back in a duplex loop for printing an image on the back side. In that case, the invention can prevent wasting all the sheets that are in the duplex loop.

Preferably, the sensor that monitors the quality of the sheets will be arranged such that it can also monitor the sheets that return from the duplex loop. Then, when a sheet has been damaged or wrinkled during its travel through the duplex loop, it may still be discarded after a first image has been printed on the first side of the sheet ready. Then, however, the rerouting mechanism for the image must also fulfil the condition that the sheet to which the back side image is routed bears the correct image on the front side.

In general, a sheet may be discarded as defective not only when it is torn or wrinkled or has a wavy surface, but also for other reasons. For example, a sheet may be rejected when its skew angle and/or its alignment in the two directions x and y in the plane of the transport path has an error that cannot be corrected.

BRIEF DESCRIPTION OF THE DRAWINGS

Embodiment examples of the invention will now be described in conjunction with the drawings, wherein.

DETAILED DESCRIPTION OF THE PREFERRED EMBODIMENTS

Figure 1:
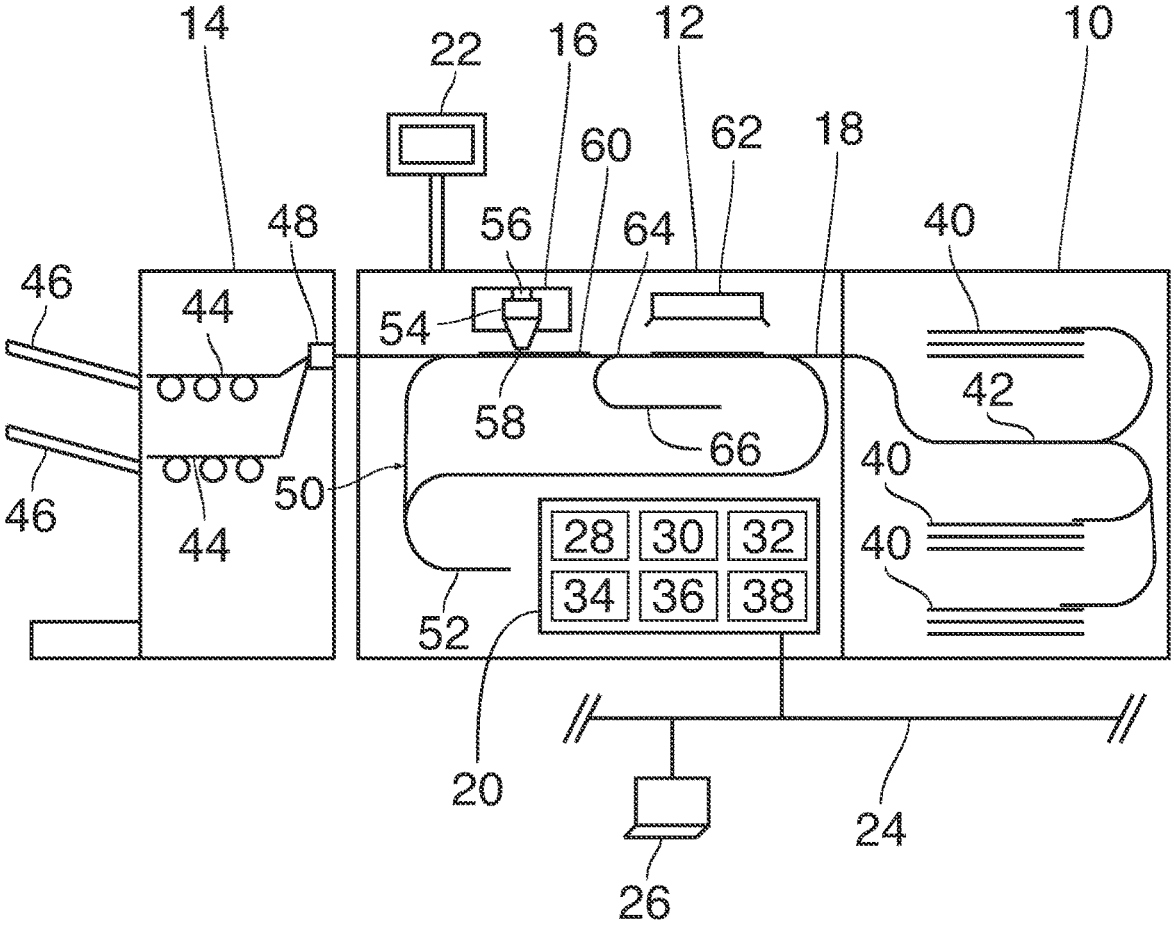
FIG. 1 is a schematic view of a printing system according to the invention.

As is shown in FIG. 1, a printing system that is described here as a representative example comprises an input section 10, a main body 12, and an output section 14. The main body 12 comprises a print station 16 disposed at a sheet transport path 18, an electronic controller 20 and a user interface 22.

The controller 20 may be formed by a computer, a server or a workstation and is connected to all the functional components of the printing system for controlling the printing system and is further connected to the user interface 22 and to a network 24 via which the controller may communicate with a remote workstation 26 of a user or operator. In an alternative embodiment, the controller 22 may also be installed outside of the main body 12 for controlling the various system components via the network 24.

The hardware and/or the software of the controller 20 includes among others a print job receiving section 28, a scheduler 30, a feed control section 32, a print control section 34, an output control section 36, and a sheet manager 38. The print job receiving section 28 is arranged to receive, e.g., via the network 24, print jobs each of which includes image data for one or more pages to be printed as well as various job settings. Optionally, the image data may also be received from a local scanner whereas the job settings are input at the user interface 22. The job settings include among others instructions that specify for each image to be printed the properties or type of a recording medium on which the image shall be printed.

The input section 10 includes a plurality of holders 40 each of which accommodates a supply, e.g. a stack of media sheets of a certain media type. The media types in the different holders 40 may differ in sheet thickness, sheet material, surface properties of the sheets and the like. The input section 10 further includes a feed mechanism 42 arranged to separate individual sheets from a selected one of the holders 40 and to supply them one by one into the sheet transport path 18 under the control of the feed control section 32.

When the job receiving section 28 has received a print job, the scheduler 30 determines a sequence in which the images of this print job shall be printed. For the purposes of this description, the term "image" shall designate a page size image that is to be printed onto one side of a recording sheet. The scheduler 30 further has access to a data base that stores the media types and properties of the sheets accommodated in the various holders 40. Based on the job settings that concern the media properties, the scheduler 30 selects the holders 40 from which the sheets with the desired properties are to be taken and determines a sequence in which the sheets of the different media types are to be fed into the sheet transport path 18 such that the sequence of sheets matches the sequence of images to be printed.

When the print process has been started, the feed control section 32 controls the feed mechanism 42 to supply the sheets in the sequence as scheduled into the sheet transport path 18, and the print control section 34 controls the print station 16 so as to print a corresponding image on the top side of each sheet.

In the example shown, the output section 14 has a plurality of holders 44 on which the sheets may be stacked after they have left the print station 16. When a stack, which may for example comprise a set of sheets forming a complete copy of a multi page document, has been completed, the holder 44 will forward the stack onto an associated output tray 46. In an alternative embodiment the completed stacks may also be forwarded to a finisher (not shown) for performing finishing operation such as stapling, punching and the like.

The output section 14 further includes a switch 48 which is controlled by the output control section 36 for directing each sheet to a designated one of the holders 44.

In the example shown, the main body 12 of the printing section also includes a duplex loop 50 which branches off from the sheet transport path 18 downstream of the print station 16, reverses the orientation of the sheets in a sheet reversing mechanism 52 and then returns the sheets upside down to the entry side of the sheet transport path 18.

It shall further be assumed in this example that the print station 16 includes as print engine an ink jet print head 54 that is disposed above the sheet transport path 18 and is adjustable in height by means of a height adjustment mechanism 56. Dependent upon the thickness and other properties of the sheets, the height of the print head 54 is adjusted such that a nozzle face 58 at the bottom side of the print head forms only a very narrow gap with a top surface of a sheet 60 that is being conveyed past the print head. In this way, it will be assured that, for each individual sheet, the ink jet print process will be performed with an optimal nozzle-to-sheet distance.

As the gap between the nozzle face 58 and the sheet 60 may be very small, any wrinkles or a surface waviness or other surface irregularities of the sheet 60 may result in a poor image quality or even in a collision of the sheet with the print head. For this reason, a sensor 62 for monitoring the quality of the sheets is disposed at the sheet transport path 18 upstream of the print station 16. The sensor 62 may for example be a 3D laser scanner that scans the entire surface of the sheet in order to capture a surface relief. The relief data are transmitted to the sheet manager 38 in the controller 20, where they are processed further to decide whether the quality of the sheet is acceptable or not. The sensor 62 may also detect other quality criteria relating to, for example, alignment errors or skew errors of the sheets.

When a sheet is found to be inacceptable, the sheet manager 38 controls a switch 64 in the sheet transport path 18 in order to excise this sheet from the scheduled sequence and to divert it into a discharge path 66 via which the sheet is discharged into a discharge bin (not shown). In this way, the defective sheet will be skipped in the print process. However, the image that was designated for being printed onto the discarded sheet must nevertheless be printed. Normally, this situation would lead to an abortion of the print process, with the result that the entire print process, including the scheduling process, has to be started anew, and all the sheets that had been present already in the sheet transport path 18 and in the duplex loop 50 would have to be discarded.

It should be observed in this context that FIG. 1 is only a schematic sketch and that, in practice, the number of sheets that can be accommodated in the sheet transport path 18 and in the duplex loop 50 may be considerably large. For example, the duplex loop 50 may be arranged to accommodate as many as 32 sheets.

In order for the print process to continue without interruption or substantial delay and in order to limit the number of sheets that have to be discarded, the sheet manager 38 performs a rerouting algorithm that reroutes the image that had to—but could not—be printed onto the defective sheet to another sheet that has suitable properties for receiving that image. An example of such a rerouting algorithm will now be explained in conjunction with FIG. 2.

Figure 2:
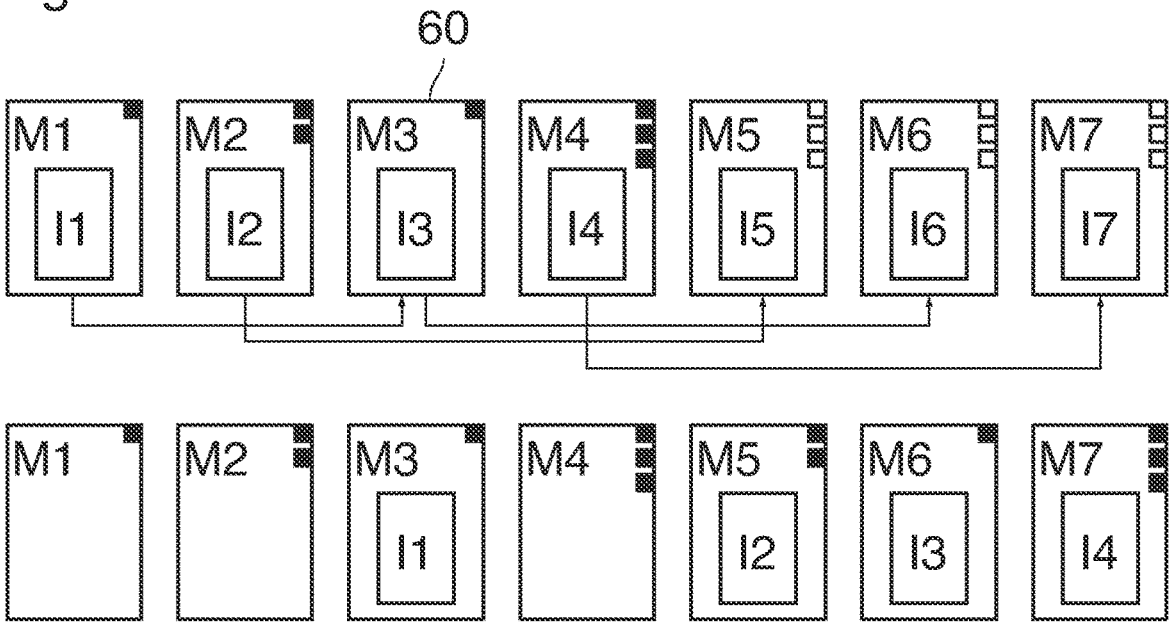
FIG. 2 is a diagram illustrating an example of rerouting images upon detection of a defective sheet in a simplex print process.

In FIG. 2, a top line shows symbolic representations of a sequence of seven sheets 60 that have been scheduled for printing and are designated as M1-M7. It will be understood that M1 is the first sheet to be fed to the print station 16, and the sheets M2-M7 will follow one after the other. The sheets M1-M4 have left the feed section 10 already and are present in the sheet transport path 18. The media type to which each sheet belongs is indicated symbolically by one, two or three black squares in the top right corner of the rectangle symbolizing the sheet. In the example shown, sheets M1 and M3 are of a first media type (one square), M2 is of a second media type (two squares), and M4 is of a third media type (three squares). The remaining sheets M5-M7 have been scheduled already by the scheduler but have not yet been fed into the sheet transport path 18, so that the media type can still be changed, if necessary. This has been symbolized by three white squares in the top right corner. The images that are scheduled for being printed on each of the sheets M1-M7 are designated as I1-I7.

It shall now be assumed that sheet M1 is just moving past the sensor 62 and the sensor detects that this sheet is defective and has to be diverted to the discharge path 66. Consequently, the sheet manager 38 has to find another sheet onto which the image I1 can be printed. It cannot be printed onto M2, because that sheet has the wrong media type. Consequently, if the order in which the images are printed (I1 first, then I2, then I3, and so on) shall be preserved, the image I2 cannot be printed onto sheet M2, neither, and sheet M2 has to be discarded as well. This means that the image I2 must also be rerouted to another sheet.

The sheet I1 can however be printed on the sheet M3 which (fortunately) has the right media type. Then, however, another sheet has to be found for receiving the image I3.

The rerouting algorithm starts with the image I1 and goes through all the subsequent sheets M2, M3, . . . in the sequence in order to find a suitable sheet to which I1 can be rerouted. In this case, it finds the sheet M3. Then, the image I2 is rerouted, again by going through the sequence of the subsequent sheets. As there is no further sheet with the correct media type (two squares) present in the transport path 18, the algorithm finally arrives at the sheet M5 which has been scheduled but not yet fed. Consequently, this sheet can still be rescheduled to match the media type of the sheet M2. That means that the sheet manager 38 commands the feed control section 32 to feed sheet M5 from the holder 40 that contains the second media type (two squares). Analogously, the image I3 is rerouted to sheet M6 which is rescheduled to match the media type of M3. The next image, I4, cannot be printed onto sheet M4, because this would disturb the print sequence. Consequently, sheet M4 has to be skipped as well and the image I4 is rerouted to sheet M7 which is suitably rescheduled. The resulting new schedule is shown in the bottom line in FIG. 2, where empty rectangles represent sheets that are skipped. The images I1-I4 are rerouted to sheets M3, M5, M6, M7 for which the respective media type has been selected in accordance with the instructions in the print job.

Thanks to this rerouting algorithm, the print run does not have to be interrupted and new sheets may continuously be scheduled for printing and only the sheets M1, M2, M4 have to be skipped and discarded, whereas sheet M3 can still be utilized. Of course, the benefit of this algorithm will increase significantly with a larger number of sheets present in the sheet transport path and the duplex loop.

In case of duplex printing, the sheets M3, M5, M6 and M7, when they have been printed in accordance with the schedule in the bottom line in FIG. 2, will not be forwarded to the output section 14 but will be diverted into the duplex loop 50 for printing another image on the back side of each sheet. Since the sheets M1, M2 and M4 have been excised from the sequence already, no further rerouting is necessary in the second pass in which the images are printed onto the back sides of the sheets.

Routing of sheets through the transport path may be established in a burst mode or in an interweaving mode. In the burst mode, at first, the duplex loop will be filled with sheets having received images on the front side, not more than the maximum number of sheets that the duplex loop can accommodate; secondly, all sheets in the duplex loop will pass in concatenation along the print head for a second time to receive images on the back side and the sheets will be outputted. This sequence is repeated until the job is done.

In the interweaving mode, once the duplex loop has been initially filled, fresh sheets continue to be fed into the transport path in an interweaving way with sheets returning from the duplex loop for a second pass along the print head. In the interweaving mode a print speed (images per minute) may be twice as high as a speed of separation in the input module and a working speed of an output module or finisher. The invention is equally applicable to both modes.

Figure 3:
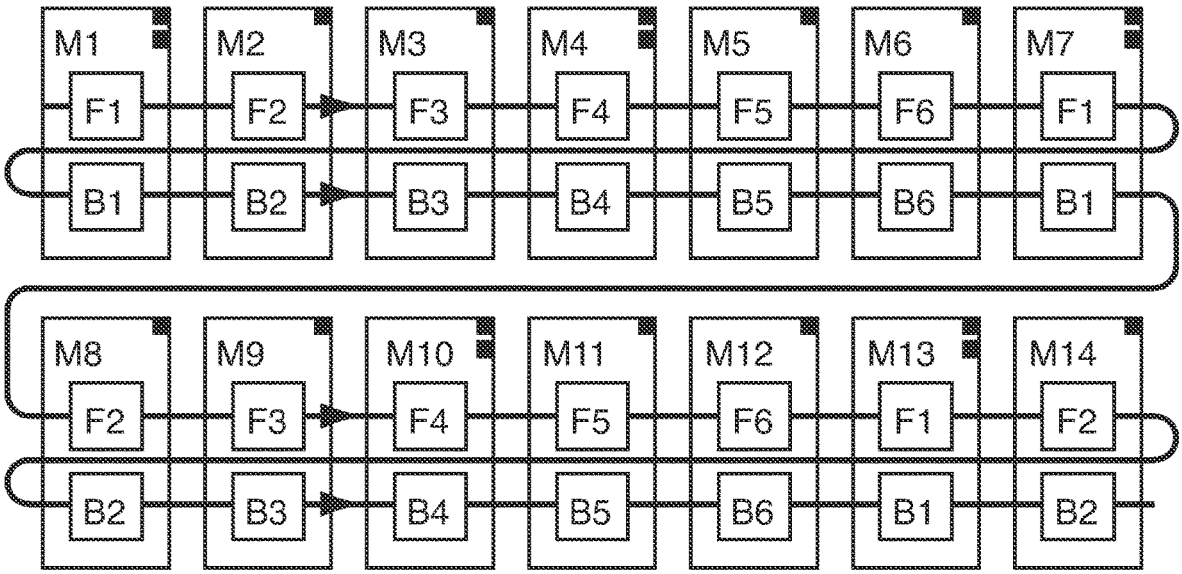
FIGS. 3 to 8 are diagrams illustrating examples of rerouting schemes for duplex print processes.

FIG. 3 illustrates a schedule for a duplex print process in burst mode wherein sheets M1-M14 are to receive images on both the front side and the back side. It is assumed that the document to be printed consists of six duplex sheets, and the images to be printed on the front sides of the first six sheets M1-M6 are designated as F1-F6 and the images to be printed on the back sides of these sheets are designated as B1-B6. Then, a new copy starts with sheet M7 which will again receive the images F1 and B1, and so on. The scheduler has accordingly selected the sheets such that M7 is of the same media type as M1, M8 of the same type as M2, and so on.

It is further assumed in this (simplified) example that the duplex loop 50 is capable of accommodating seven sheets. Consequently, the sheets M1-M7 form a first batch of sheets that will be printed on a first side one after the other. When the image F1 has been printed onto sheet M7, the sheet M1 will have returned from the duplex loop so that, in the next print cycle, the image B1 will be printed on the back side of sheet M1. The sequence in which the front and back side images are printed has been indicated by a bold serpentine line in FIG. 3.

Figure 4:
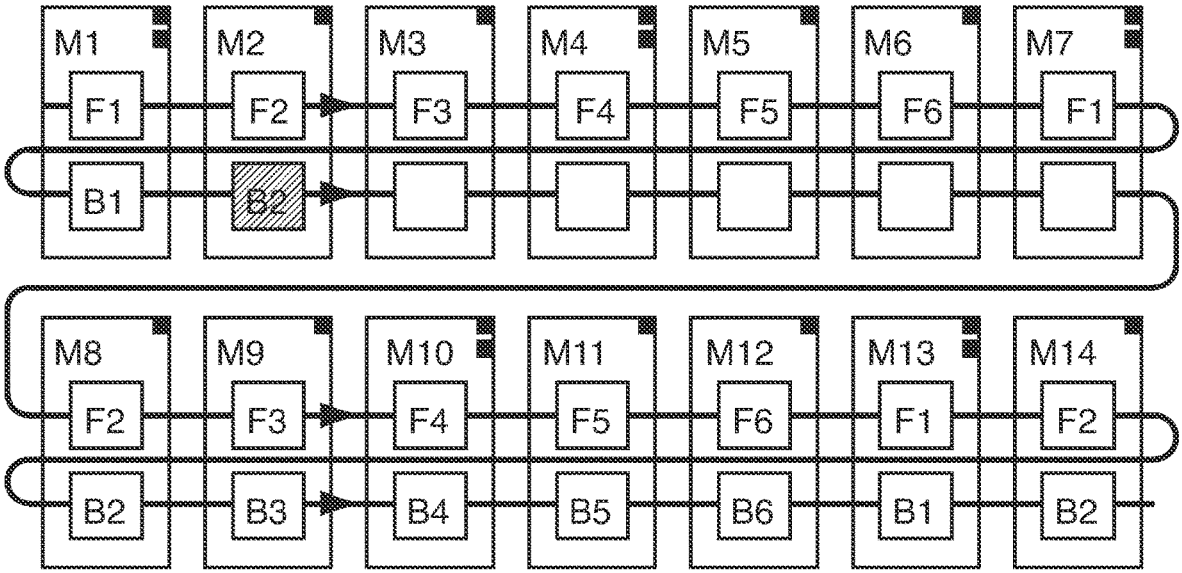

FIG. 4 illustrates a case wherein, in the same print job as in FIG. 3, the front side images have been printed on the sheets M1-M7 of the first batch, and no defective sheets have been detected. However, sheet M2 has become damaged somewhere on its way through the duplex loop. Consequently, when sheet M2 returns from the duplex loop and passes the sensor 62 a second time, a defect is detected, to that this sheet has to be discarded. This has been symbolized in FIG. 4 by a hatching of the box representing the image B2 which cannot be printed on this sheet. Now, the image B2 has to be rerouted to a sheet that is not only of the correct media type (as would be the case for the next sheet M3), but also bears the correct image F2 on the front side. The first sheet that fulfils this condition is sheet M8. Consequently, the sheets M3-M7 (with images printed already on the front side) have to be discarded, as has been symbolized in FIG. 4 by empty boxes for the back side images. The print process may then be continued with M8 without interruption, and no rescheduling of the subsequent sheets is necessary in this case.

In the example shown in FIGS. 3 and 4, the second media type (two squares) is specified for the first and the fourth sheet (e.g. sheets M1 and M4) of each six sheet copy of the document, whereas the other sheets are of the first media type. If, in order to obtain an optimal print quality, the height of the print head 54 is adjusted individually for each media type and the first and second media types require different heights, then the height has to be re-adjusted after printing M1, and it has to be readjusted again after printing M3 and again after printing M4, and once again after printing M6. Since these adjustment operations will take a certain time, the productivity is compromised to some extent.

In this specific example, however, the number of sheets (six) of a single copy of the document happens to be just one sheet less than the number of sheets (seven) that the duplex loop 50 can accommodate. Consequently, the last sheet M7 of the batch has the same media type as the first sheet M1. This has the fortunate effect that no re-adjustment of the print head is necessary when sheet M7 has been printed and then the back side image B1 has to be printed on the sheet M1 returning from the duplex loop. As the print operation proceeds, a similarly fortunate constellation occurs when the back side image B2 has been printed on sheet M14 and then a front side image (F3) has to be printed on the front side of the next sheet. Again, these sheets have the same media type (just as M2 and M3), so that no re-adjustment of the print head is necessary. Thus, at least one adjustment operation per copy can be saved.

In the more general case, however, with each copy of the document comprising a smaller or larger number of pages or with the number of sheets that can be accommodated in the duplex loop being different, the productivity would be worse.

Figure 5:
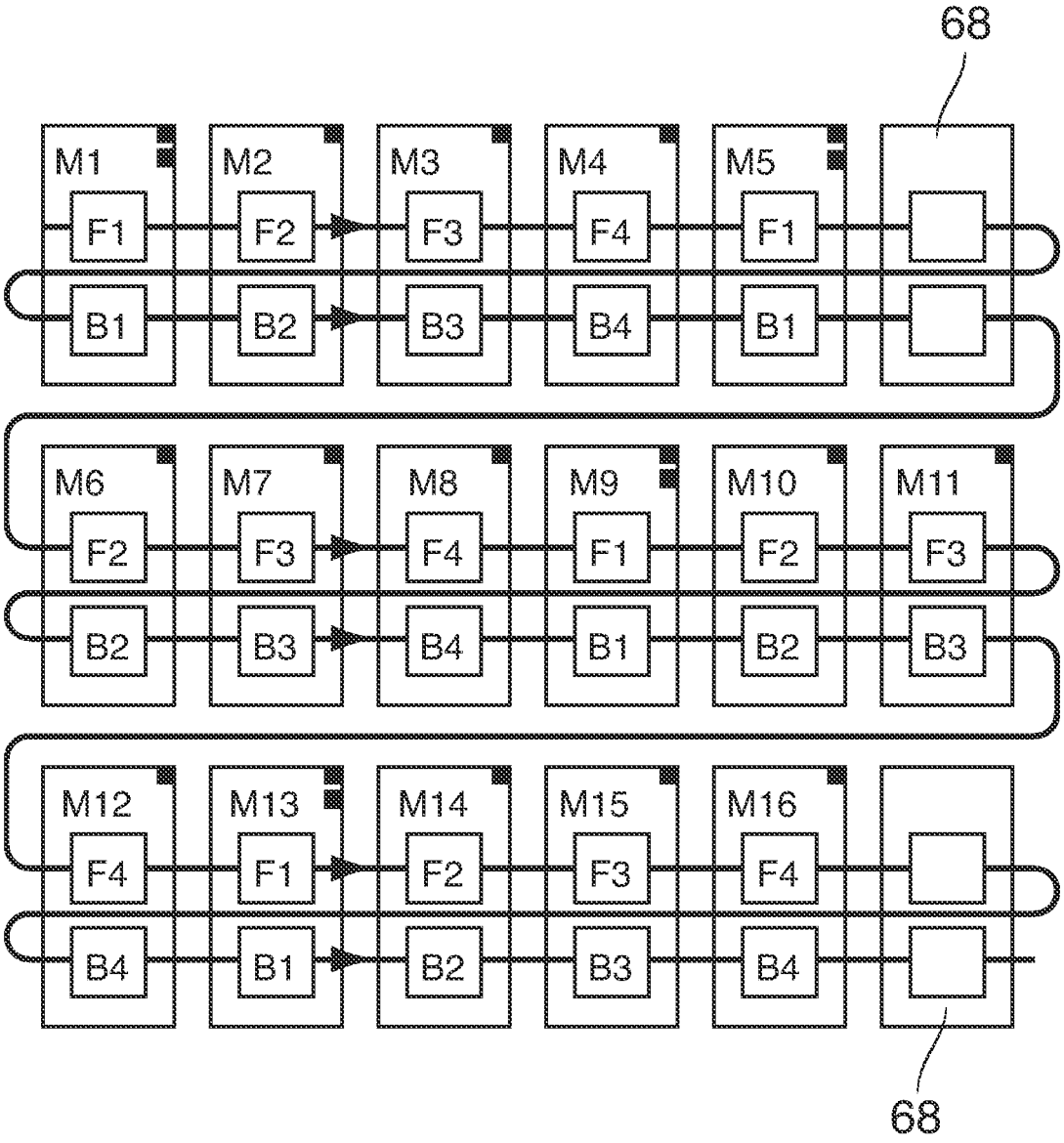

FIG. 5 illustrates such an example in which the duplex loop can accommodate only six sheets. The print job to be printed in this example consists of copies of a document with four duplex sheets having images F1-F4 on the front side and images B2-B4 on the back side. The first sheet (M1, M5, M9, etc.) of each copy is of the second media type, and all the other sheets are of the first media type. Consequently, the media types constitute a repetitive pattern 2_1_1_1-2_1_1_1 . . . .

Using known algorithms, the scheduler 30 is capable of recognizing this pattern, and in order to minimize the number of adjustment operations of the print head, the schedule shown in FIG. 5 provides an empty space 68 in the sheet supply sequence after sheet M5. As a result, the last sheet M5 of the first batch ends with a sheet of the same media type as the first sheet M1, so that no adjustment of the print head is necessary between printing the front side image F1 on sheet M5 and printing the back side image B1 on sheet M1, similarly as in FIG. 4.

In the next batch (M6-M11), no empty space is needed in order to avoid an adjustment operation between printing F3 on sheet M11 and printing B2 on sheet M6. Then, in the next batch an empty space 68 will be needed again.

Thus, by observing the repetitive pattern of the media types in the sequence and by appropriately controlling the timings at which the sheets returning from the duplex loop 50 are re-inserted into the sequence of sheets in the sheet transport path 18 (e.g. by leaving empty spaces), it is possible to reduce the number of necessary adjustment operations and thereby to increase the productivity.

Figure 6:
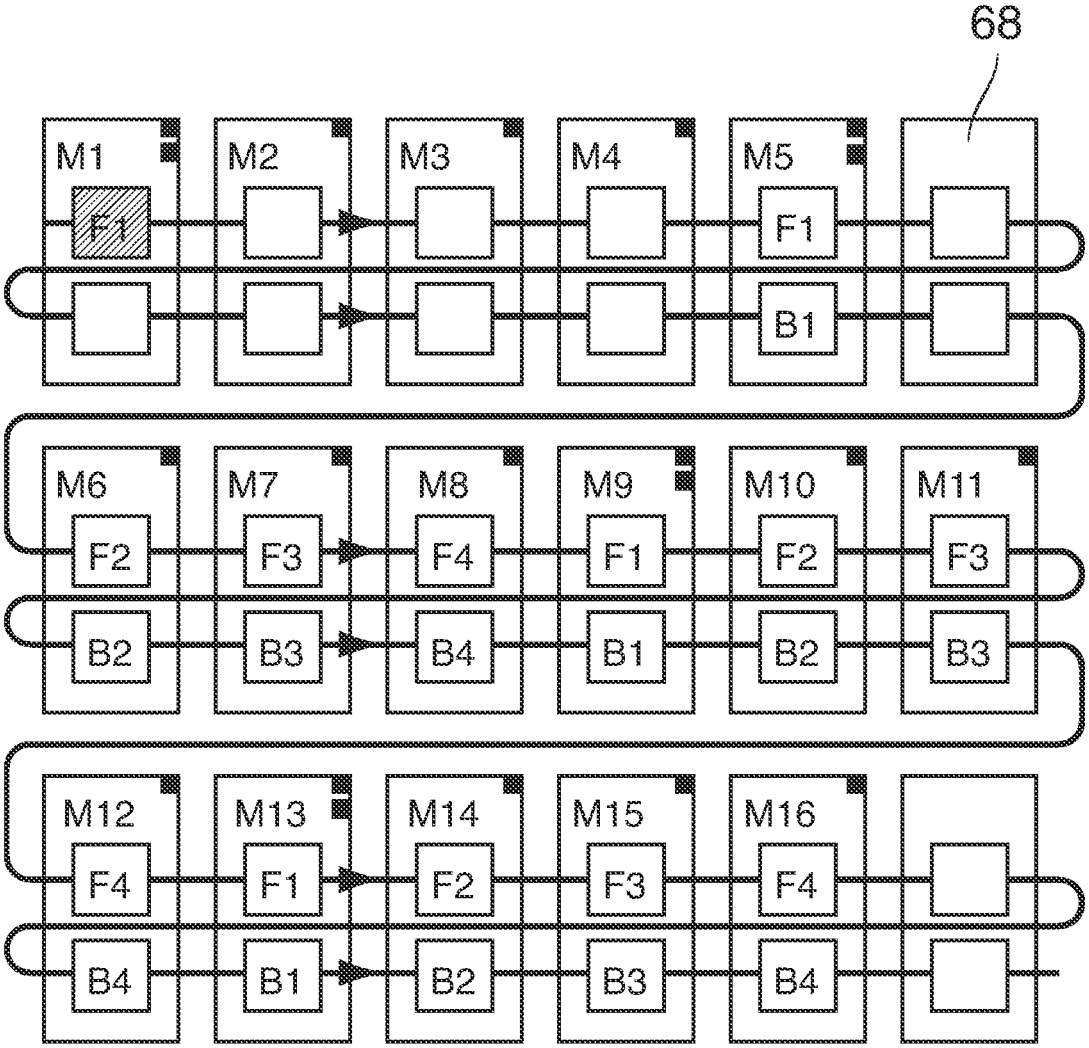

Now, considering the same print job as in FIG. 5, FIG. 6 illustrates a situation where the sensor 52 detects that the sheet M5 is defective. The defect is detected already in the first pass of the duplex print process, i.e. before the image F1 is printed. As a consequence, sheet M1 has to be skipped, and the image F1 (and also the image B1) has to be rerouted to sheet M5 which is the next sheet with the correct media type. Consequently, sheets M3-M4 have to be discarded. Then, in this example, the sequence of images to be printed and the repetitive pattern of media types are in synchronism again, so that the print operation may proceed just as in FIG. 5, with empty spaces 68 provided where necessary.

In a more complex scenario, a re-scheduling of the subsequent sheets may be necessary. In any case, the repetitive pattern of media types will be taken into account in the re-scheduling process, so that the high productivity is preserved.

Figure 7:
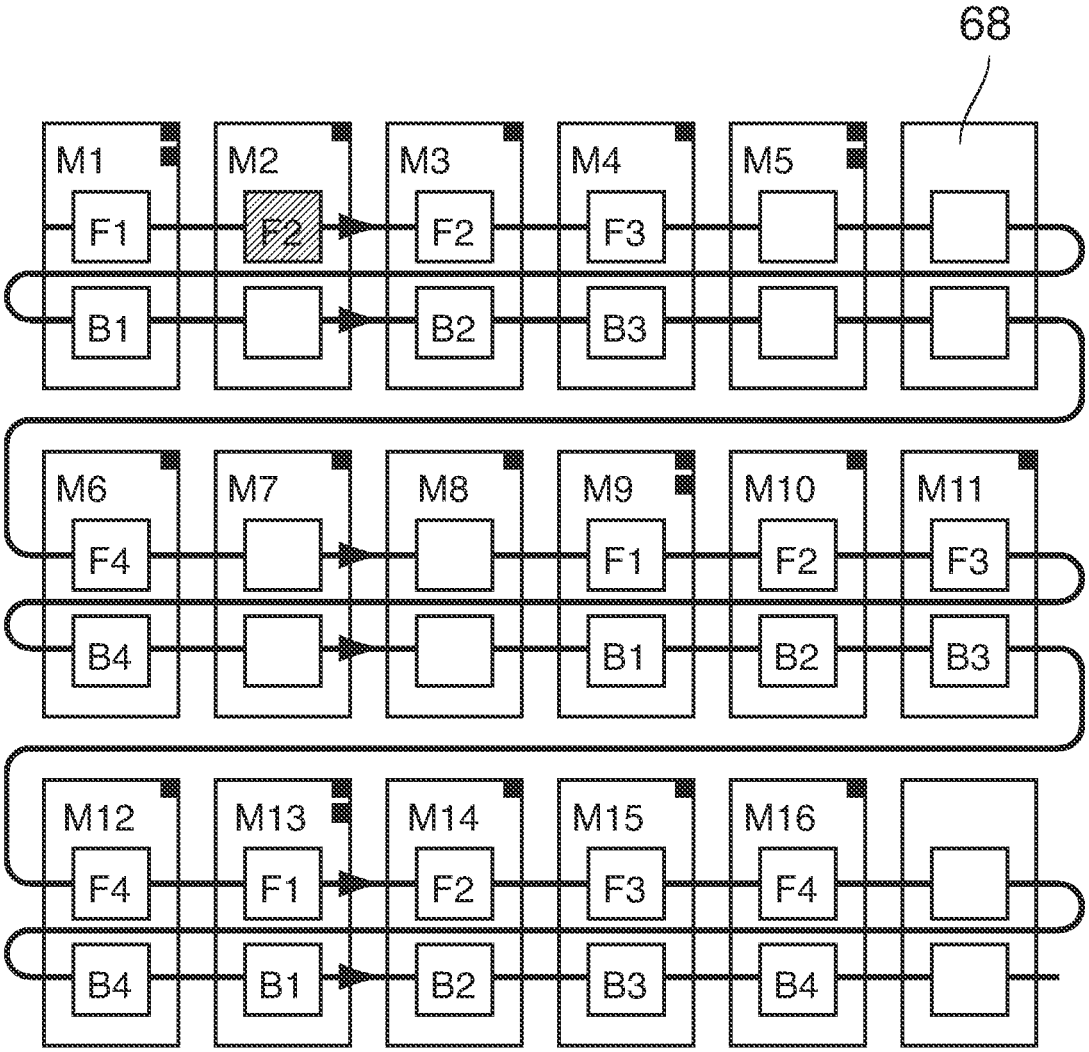

As another example, FIG. 7 illustrates a case wherein, in the same print job as in FIGS. 5 and 6, it is detected in the first pass (immediately before printing the image F2) that the sheet M2 is defective. In that case, the images F2 and B2 can be rerouted to sheet M3, which has the same media type, and images F3 and B3 can be rerouted to sheet M4. The images F4 and B4 must however be rerouted to sheet M6. Sheet M5 has to be skipped because it has the wrong media type, and the next space on the transport path must be an empty space 68 again in order to avoid a loss in productivity. The next images F1 and B1 which are to be formed on the first sheet of the next copy have to be rerouted to sheet M9 because the sheets M7 and M8 have the wrong media type. Then, a situation has again been reached where the sequence of images to be printed is in synchronism with the repetitive pattern of the media types, so that the print operation may proceed as scheduled. Again, if a re-scheduling should be necessary in a more complex scenario, the re-scheduling is performed such that empty spaces 68 are left in the appropriate places.

Figure 8:
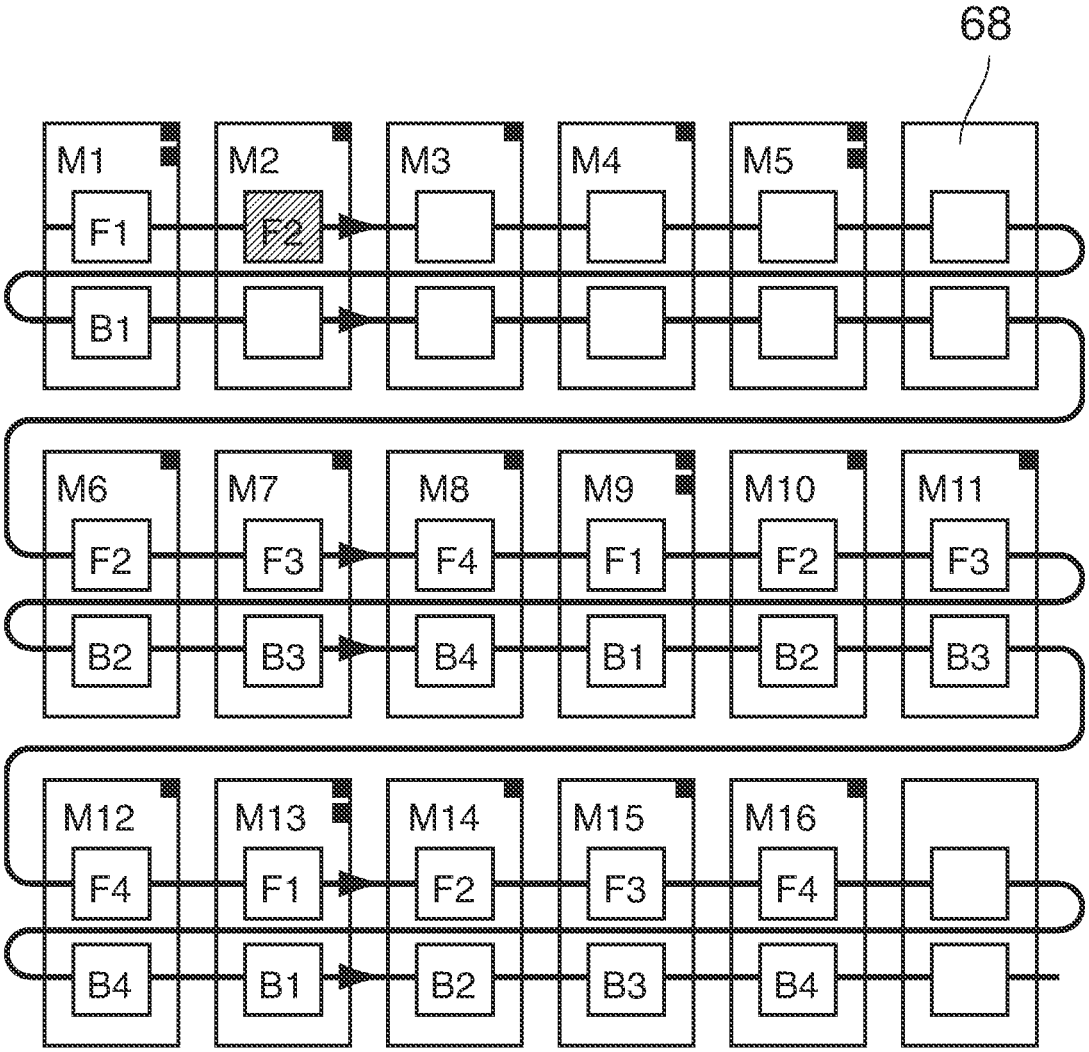

In the situation considered in FIG. 7 there exist alternative rerouting schemes, as has been exemplified in FIG. 8. Instead of rerouting the images F2 and F3 to sheet M3, they are rerouted directly to sheet M6, and images F3 and B3 are rerouted to sheet M7, so that, unlike in FIG. 7, the sheets M7 and M8 need not be discarded. This has the advantage that the switch 64 needs to be operated less frequently.

Since the sheet M1 is still in the duplex loop when the defect of sheet M2 is detected, it would also be possible to discard sheet M1 when it reaches the switch 64 in the second pass (before printing B1), and to use sheet M5 instead for printing the first document sheet with the images F1 and B1. However, this would imply a higher consumption of ink because the image F1 would be printed twice.

Comparing the three rerouting schemes, it can be seen that, in this simple example, the number of sheets that have to be discarded is the same. There may however be more complex scenarios where one of the possible rerouting schemes would produce less waste than the others. The rerouting algorithm in the sheet manager 38 may therefore be programmed to test all possibilities and then select the best one.

In the examples shown in FIGS. 5 to 7, the repetitive pattern of media types (one sheet of the second type and three sheets of the first type) is due to the repeated printing of identical copies of the same document. In a more general case, however, the repetitive pattern of images to be printed (with a length corresponding to the number of sheets of one copy) may include two or more repetitions of a repetitive pattern of the media types. As an example, reference can be made to FIG. 3 where a single copy of the document comprises six sheets M1-M6 and includes two repetitions of media types 2_1_1. In such cases, the pattern recognition algorithm will recognize the media type pattern (with a length of three sheets in this example) even when the length of the document is larger (six sheets). Consequently, the optimization of the rerouting scheme can and should be based on the shorter repetitive pattern of the media types.

In the examples that have been described so far, the rerouting of images and the re-scheduling of sheets is always performed in such a manner that the order in which the images are printed will be preserved. This restriction, however, is not compulsory. For example, when the printed copies are stacked on the upper holder 44 of the output section 14 in FIG. 1 whereas the lower holder 44 is idle, there are additional possibilities for avoiding losses in productivity and waste of material and still obtaining collated copies.

For example, when a sheet is found to be defective and the next sheet in the sequence has the wrong media type so that it would have to be discarded as well, it may be that the media type of this second sheet is the same as the media type of the first sheet of the copy. Then, this sheet may be used for starting with another copy of the document even though the previous copy has not yet been completed. When the first page of the document has been printed on the sheet that otherwise would have been discarded, the switch 48 is controlled to direct this sheet into the lower holder 44 for starting the new copy of the document. Then, the number of discarded sheets may be minimized by switching between the two holders 44, and finally the copies in both holders will be completed by appropriately re-scheduling the sheets to be fed into the sheet transport path 18.

What is claimed is:

1. A printing system comprising:

a print station disposed at a sheet transport path;

a feed section arranged to feed media sheets of different media types into the transport path so as to be fed sequentially to the print station; and a controller arranged to receive print instructions concerning images to be printed, to schedule a sequence of the media sheets, and to control the feed section and the print station such that each image is printed on a sheet of a media type that has been specified for that image in the print instructions, wherein a sensor is arranged at the transport path for detecting a quality condition of the sheets being fed to the print station, and the controller is adapted to receive a quality signal from the sensor and, when the quality of a sheet is found to be insufficient, to skip that sheet and to reroute the corresponding image to another scheduled sheet that is compatible with the print instructions, wherein the controller, when processing a print job that provides printing a plurality of images in a predetermined order, is configured to reroute the images with conservation of the print order, by rerouting an image for a sheet, that precedes a target sheet to which the image for the defective sheet has been rerouted, to a sheet that follows that target sheet in the sequence.

2. The printing system according to claim 1, wherein the controller is adapted to re-schedule sheets that had been scheduled already but have not yet been fed into the sheet transport path.

3. The printing system according to claim 1, wherein the controller is adapted to use pattern recognition for recognizing a repetitive pattern in the media types of the sheets that have been scheduled and to reroute the images on the basis of the recognized pattern.

4. The printing system according to claim 1, wherein the sensor is arranged to scan a surface relief of a sheet that is moving past the sensor.

5. The printing system according to claim 1, comprising a switch that is disposed in the sheet transport path in a position between the sensor and the print station and is arranged to divert sheets into a discharge path.

6. The printing system according to claim 1, comprising a duplex loop, wherein the sensor is disposed at a point of the sheet transport path between the print station and a junction where sheets returning from the duplex loop enter into the sheet transport path again.

7. The printing system according to claim 2, wherein the sensor is arranged to scan a surface relief of a sheet that is moving past the sensor.

8. The printing system according to claim 3, wherein the sensor is arranged to scan a surface relief of a sheet that is moving past the sensor.

9. The printing system according to claim 4, comprising a switch that is disposed in the sheet transport path in a position between the sensor and the print station and is arranged to divert sheets into a discharge path.

10. The printing system according to claim 4, comprising a duplex loop, wherein the sensor is disposed at a point of the sheet transport path between the print station and a junction where sheets returning from the duplex loop enter into the sheet transport path again.

11. The printing system according to claim 6, wherein, when the sheet for which an insufficient quality has been detected is one that bears an image on a front side already, the controller is adapted to reroute an image that was scheduled for a back side of that sheet to another sheet that bears the same front side image.

12. A printing method for printing images onto media sheets of different media types in a printing system comprising a print station, a feed section, a controller and a sheet transport path for feeding the sheets sequentially from the feed section to the print station, the method comprising the steps of:

scheduling a sequence of the media sheets;

controlling the feed section and the print station such that each image is printed on a sheet of a media type that has been specified for that image;

detecting a quality condition of the sheets being fed to the print station; and when the quality of a sheet is found to be insufficient, skipping that sheet and rerouting the corresponding image to another scheduled sheet that is compatible with the specified media type, wherein the controller, when processing a print job that provides printing a plurality of images in a predetermined order, is configured to reroute the images with conservation of the print order, by rerouting an image for a sheet, that precedes a target sheet to which the image for the defective sheet has been rerouted, to a sheet that follows that target sheet in the sequence.

13. A software product comprising program code on a non-transitory computer-readable medium, wherein said program code, when loaded into a computer that is connected to a printing system having a print station disposed at a sheet transport path, a feed section arranged to feed media sheets of different media types into the transport path so as to fed sequentially to the print station, and a sensor arranged at the transport path for detecting a quality condition of the sheets being fed to the print station, causes the computer to act according to the method of claim 12.

14. The printing system according to claim 1, wherein, when the sheet for which an insufficient quality has been detected is one that bears an image on a front side already, the controller is adapted to reroute an image that was scheduled for a back side of that sheet to another sheet that bears the same front side image.

15. The printing method according to claim 12, wherein the controller is adapted to re-schedule sheets that had been scheduled already but have not yet been fed into the sheet transport path.

16. The printing method according to claim 12, wherein the controller is adapted to use pattern recognition for recognizing a repetitive pattern in the media types of the sheets that have been scheduled and to reroute the images on the basis of the recognized pattern.

17. The printing method according to claim 12, wherein a sensor is arranged at the transport path for detecting the quality condition of the sheets being fed to the print station, and the sensor is arranged to scan a surface relief of a sheet that is moving past the sensor.

18. The printing method according to claim 12, wherein the printing system further comprises a switch disposed in the sheet transport path in a position between the sensor and the print station and is arranged to divert sheets into a discharge path.

19. The printing method according to claim 12, wherein the printing system further comprises a duplex loop, and wherein the sensor is disposed at a point of the sheet transport path between the print station and a junction where sheets returning from the duplex loop enter into the sheet transport path again.

* * * * *